US007973748B2

(12) United States Patent
Chiou

(10) Patent No.: US 7,973,748 B2
(45) Date of Patent: Jul. 5, 2011

(54) DATADRIVER AND METHOD FOR CONDUCTING DRIVING CURRENT FOR AN OLED DISPLAY

(75) Inventor: Yu-Wen Chiou, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 944 days.

(21) Appl. No.: 11/866,744

(22) Filed: Oct. 3, 2007

(65) Prior Publication Data

US 2009/0091520 A1 Apr. 9, 2009

(51) Int. Cl.
*G09G 3/30* (2006.01)

(52) U.S. Cl. ..... 345/82; 345/77

(58) Field of Classification Search ..... 345/76–77
See application file for complete search history.

(56) References Cited

U.S. PATENT DOCUMENTS

2006/0125735 A1* 6/2006 Pae ..... 345/76
2007/0171177 A1* 7/2007 Kim et al. ..... 345/100
2008/0030444 A1* 2/2008 Hsueh ..... 345/87

* cited by examiner

*Primary Examiner* — Chanh Nguyen
*Assistant Examiner* — Long Pham
(74) *Attorney, Agent, or Firm* — Lowe, Hauptman, Ham & Berner, LLP

(57) ABSTRACT

A data driver for an OLED display has a resistor string, digital-to-analog converters and converting transistors. The resistor string provides a set of gamma voltages. Each of the digital-to-analog converters converts an input word into an output voltage selected from the gamma voltages. Each of the converting transistors conducts a driving current and having a gate-to-source voltage determined by the output voltage from one of the digital-to-analog converters. A method of data driving for an OLED display is also disclosed.

4 Claims, 9 Drawing Sheets

DATADRIVER AND METHOD FOR CONDUCTING DRIVING CURRENT FOR AN OLED DISPLAY

BACKGROUND

1. Field of Invention

The present invention relates to an OLED display. More particularly, the present invention relates to a data driver of an OLED display.

2. Description of Related Art

FIG. 1 is a conventional current-type data driver 100 of an OLED display. A set of current mirror 102 mirrors a multiple of the reference current $I_{REF}$ to each of several current paths 112 coupled to one of the channel 1 to N. Each current path 112 is conducted according to one bit (e.g. b0, b1, b2 or b3) of an input word and the current signal $I_{OUT}$ outputting to the channel is a sum of currents flowing through the conducted current paths 112. However, the conventional data driver 100 performs a linear gamma curve of its digital to analog conversion without any gamma correction. Therefore, the prior art needs to combine two or more sets of current mirror 102 for one channel to obtain a non-linear gamma curve with gamma correction.

SUMMARY

According to one embodiment of the present invention, a data driver for an OLED display comprises a resistor string, a plurality of digital-to-analog converters and a plurality of converting transistors. The resistor string provides a set of gamma voltages. Each of the digital-to-analog converters converts an input word into an output voltage selected from the gamma voltages. Each of the converting transistors conducts a driving current and having a gate-to-source voltage determined by the output voltage from one of the digital-to-analog converters.

According to another embodiment of the present invention, a method of data driving for an OLED display is provided. A set of gamma voltages is provided. An input word is converted into an output voltage selected from the gamma voltages. A driving current is conducted by a converting transistor having a gate-to-source voltage which is determined by the output voltage.

It is to be understood that both the foregoing general description and the following detailed description are examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
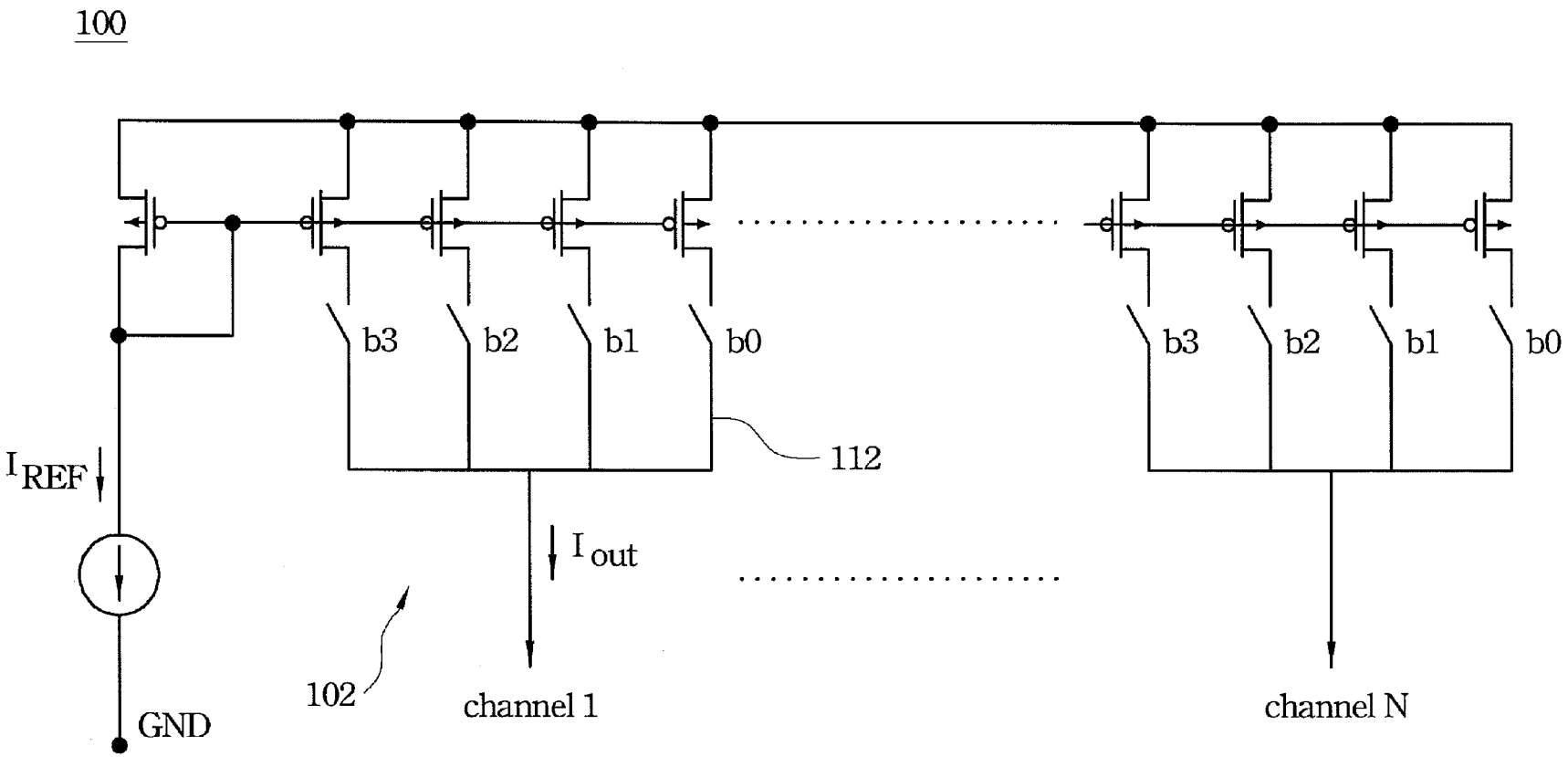
Fig. 1 (Prior Art)
FIG. 1 is a conventional current-type data driver of an OLED display.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
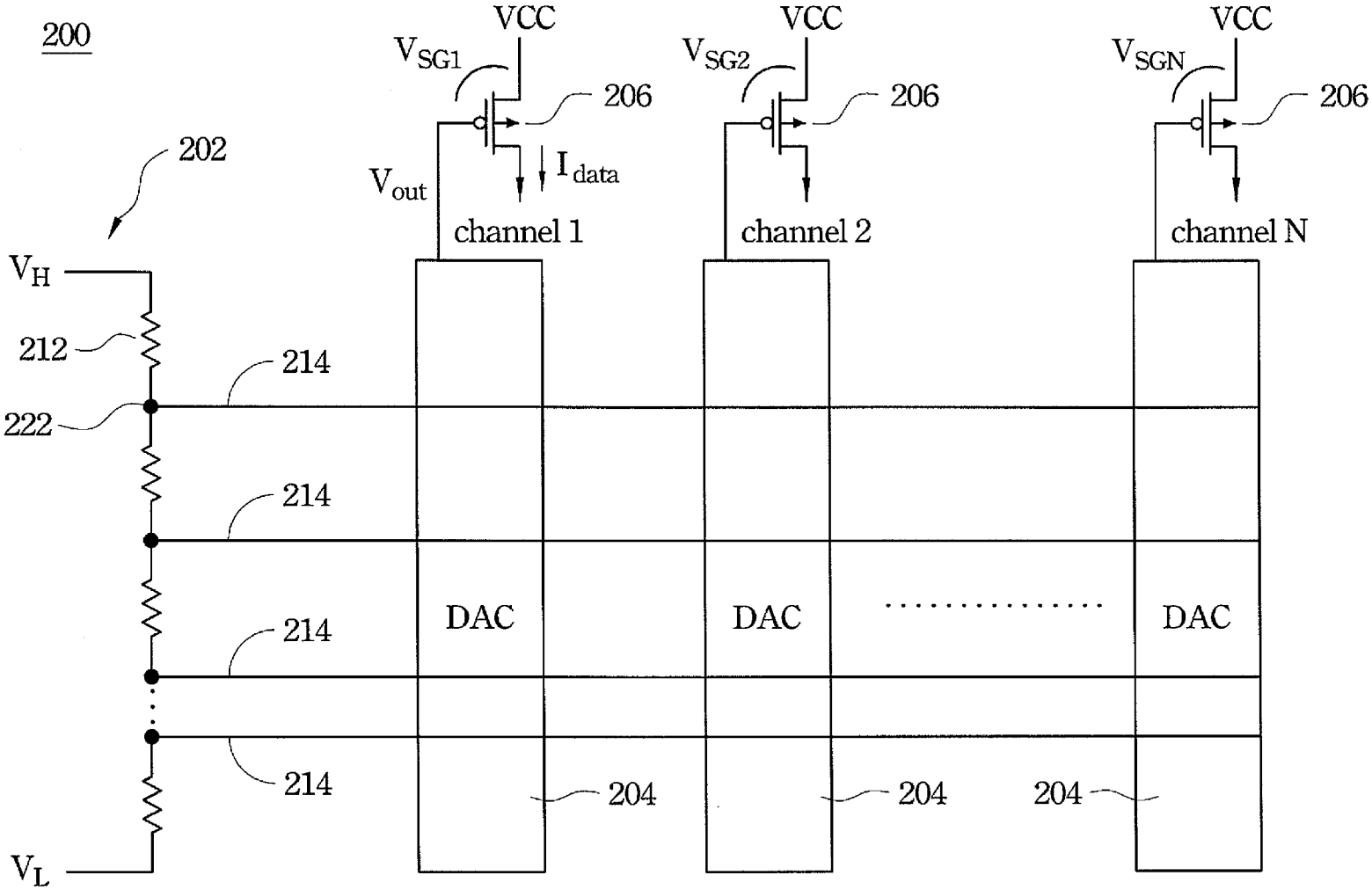
FIG. 2A is a data driver for an OLED display according to one embodiment of the present invention.

FIG. 2A is a data driver 200 for an OLED display according to one embodiment of the present invention. The data driver 200 has a resistor string (R-string) 202, digital-to-analog converters (DACs) 204 and converting transistors 206. The resistor string 202 provides a set of gamma voltages. Each of the digital-to-analog converters 204 converts an input word into an output voltage $V_{out}$ selected from the gamma voltages. Each of the converting transistors 106 conducts a driving current $I_{data}$ and having a gate-to-source voltage VSG determined by the output voltage $V_{out}$ from one of the digital-to-analog converters 204.

Figure 3:
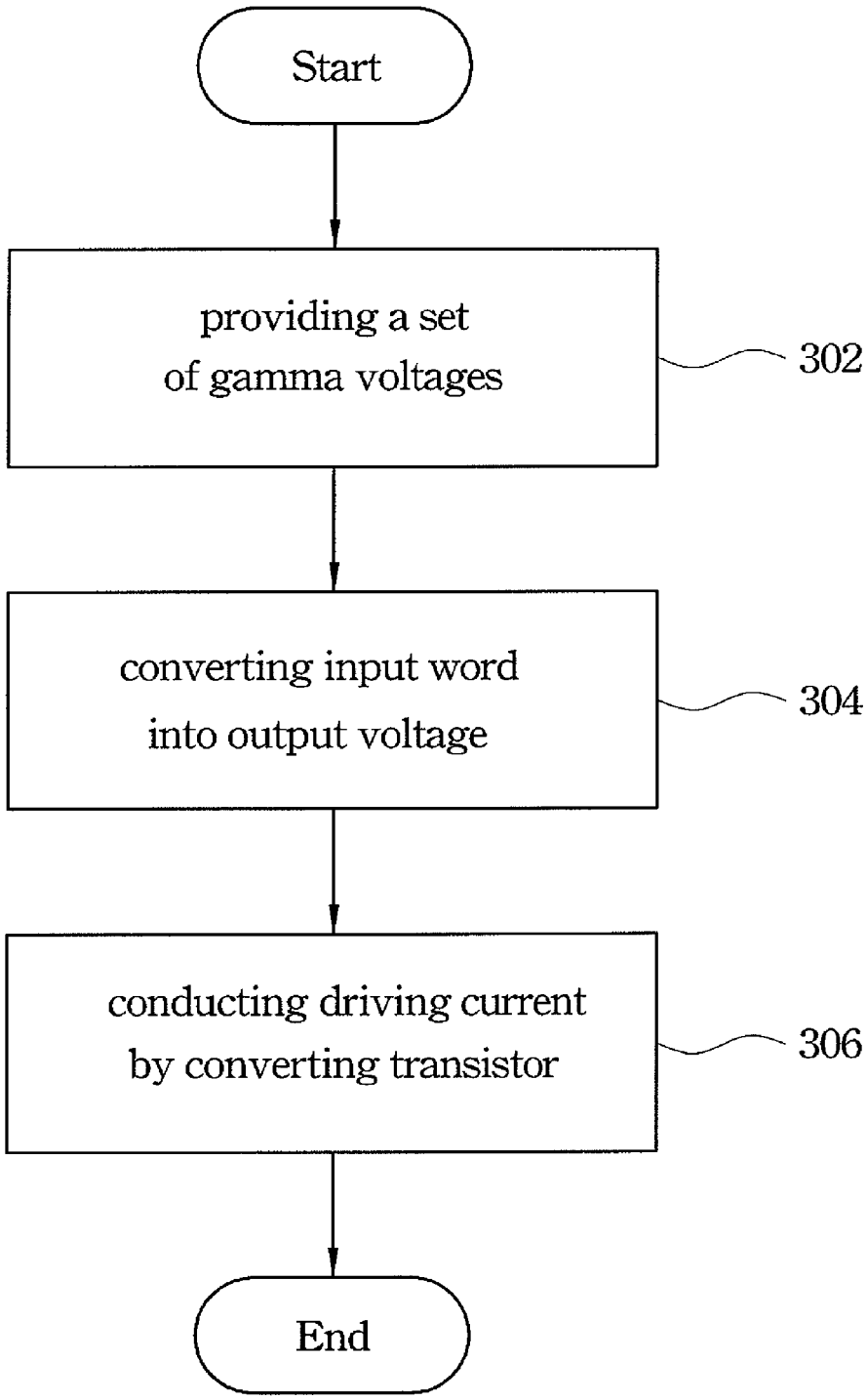
FIG. 3 is a method of data driving for an OLED display according to another embodiment of the present invention.

FIG. 3 is a method of data driving for an OLED display according to another embodiment of the present invention. The following description is made with reference to FIGS. 2A and 3. A set of gamma voltages is firstly provided (step 302). An input word is converted into an output voltage $V_{out}$ selected from the gamma voltages (step 304). A driving current $I_{data}$ is conducted by a converting transistor 206 having a gate-to-source voltage VSG which is determined by the output voltage $V_{out}$(step 306).

The data driver 200 is provided for use in an OLED display to accomplish the modulations of brightness, contrast or gray scale of OLED pixels. The resistor string 202 has resistors 212 connected in series between a high reference voltage $V_H$ and a low reference voltage $V_L$ and constitutes tap points 222 to provide the set of gamma voltages. Each of the digital-to-analog converters 204 corresponds to one of the channel 1 to N of the OLED display. The digital-to-analog converters 204 include selecting lines 214, and each of the selecting lines 214 is coupled to one of the tap points 222 constituted by the series-connected resistors 212. The selecting line 214 has several switching elements (not illustrated), of which each is switched by one bit of the input word, respectively. In practice, what is used to switch the switching elements may be one bit of the input word itself or the complement of the bit.

By the digital-to-analog converter 204, the output voltage $V_{out}$, which is selected from the gamma voltages to couple to the converting transistor 206, can be an inherently monotonic analog representation of the input word. The output voltage $V_{out}$ is coupled to a gate of the converting transistor 206, the driving current $I_{data}$ is outputted from a drain of the converting transistor 206 and a supply voltage VCC is coupled to a source of the converting transistor 206. That is, the converting transistor 206 thus converts the output voltage $V_{out}$ into the driving current $I_{data}$ for the corresponding channel.

Figure 2B:
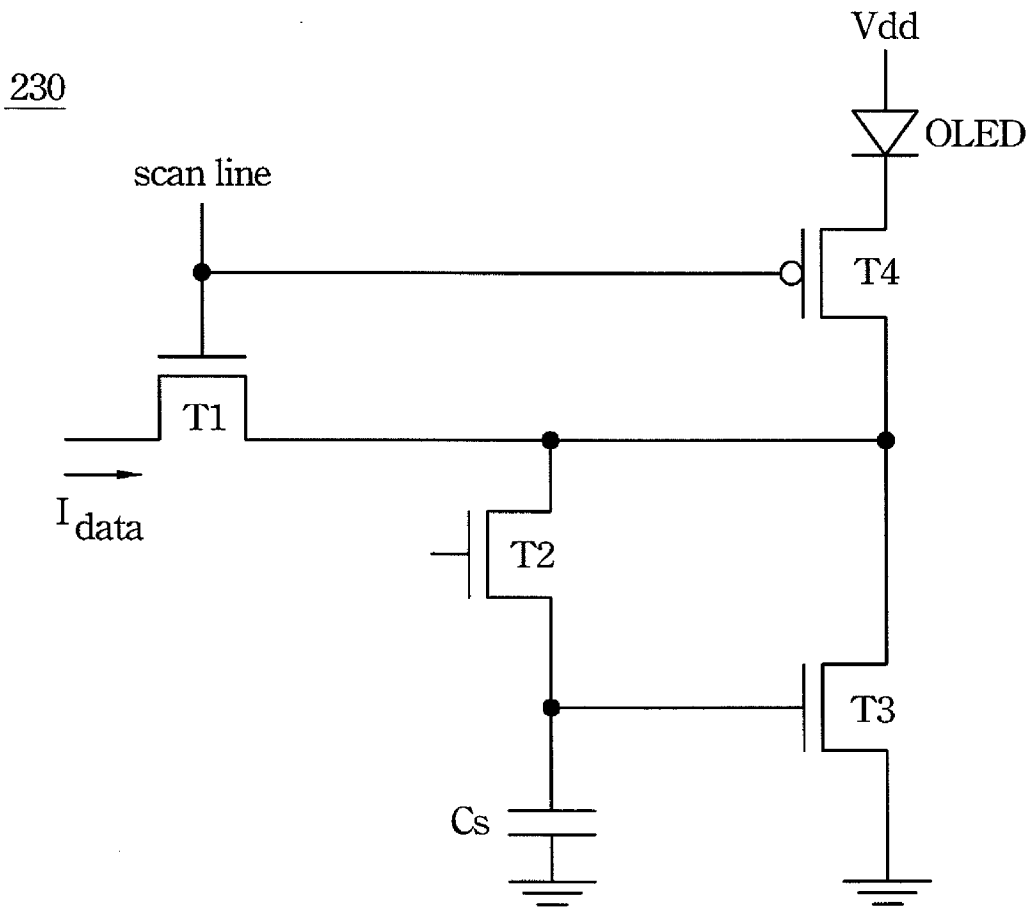
FIG. 2B is an exemplary current-sink type pixel circuit receiving the driving current from the data driver of FIG. 2A.

The driving current $I_{data}$ is generated according to the output voltage $V_{out}$ and the supply voltage VCC coupled to the gate and the source of the converting transistor 206, respectively. In the embodiment in FIG. 2A, the converting transistor 206 is a PMOS transistor, which conducts the driving current $I_{data}$ provided for a pixel circuit 230 of the current-sink type as illustrated in FIG. 2B. The driving current $I_{data}$ is input into the exemplary current-sink type pixel circuit 230 including four transistors T1, T2, T3, T4 and an OLED.

Figure 4A:
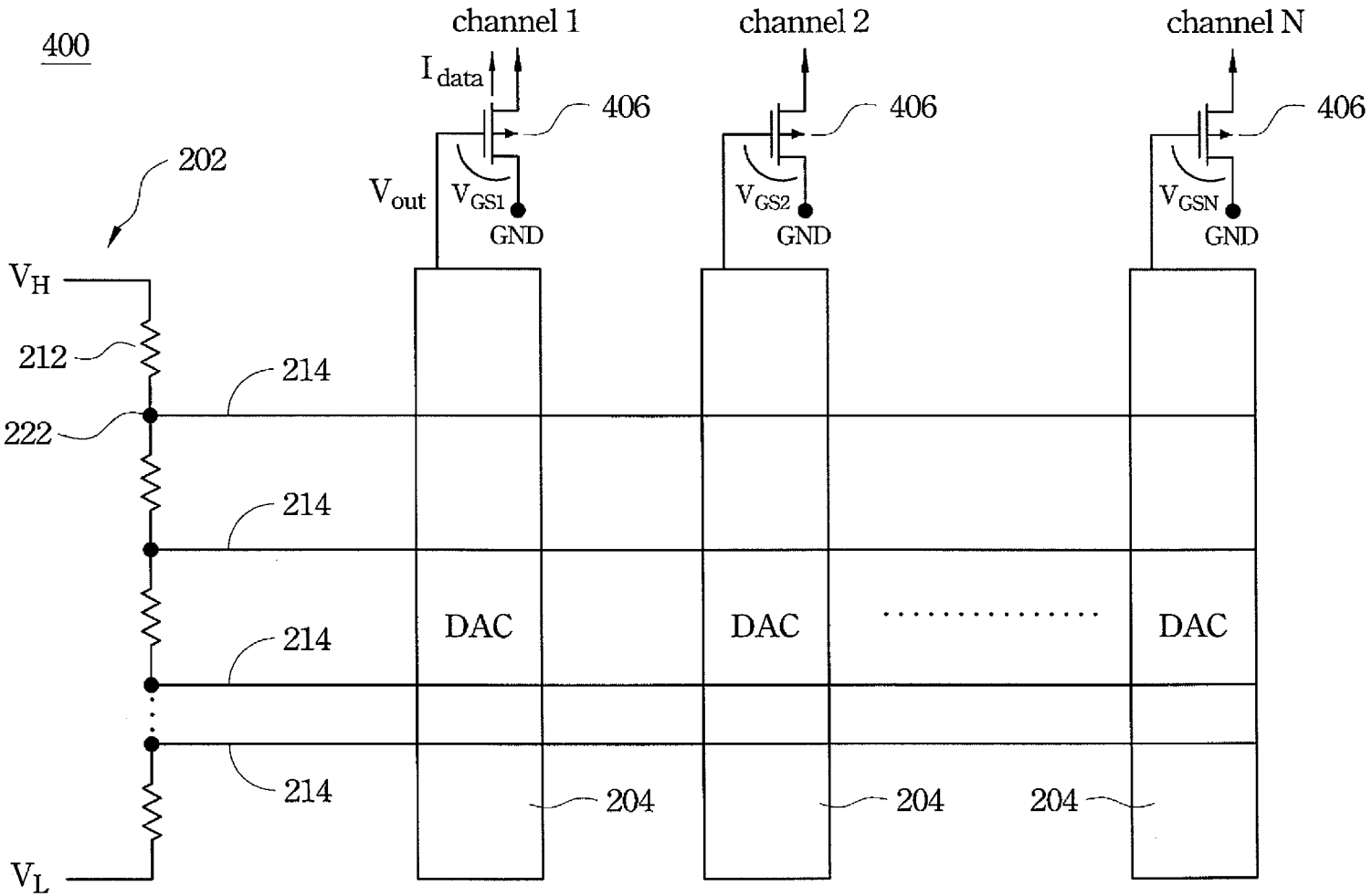
FIG. 4A is a data driver for an OLED display according to another embodiment of the present invention.
Figure 4B:
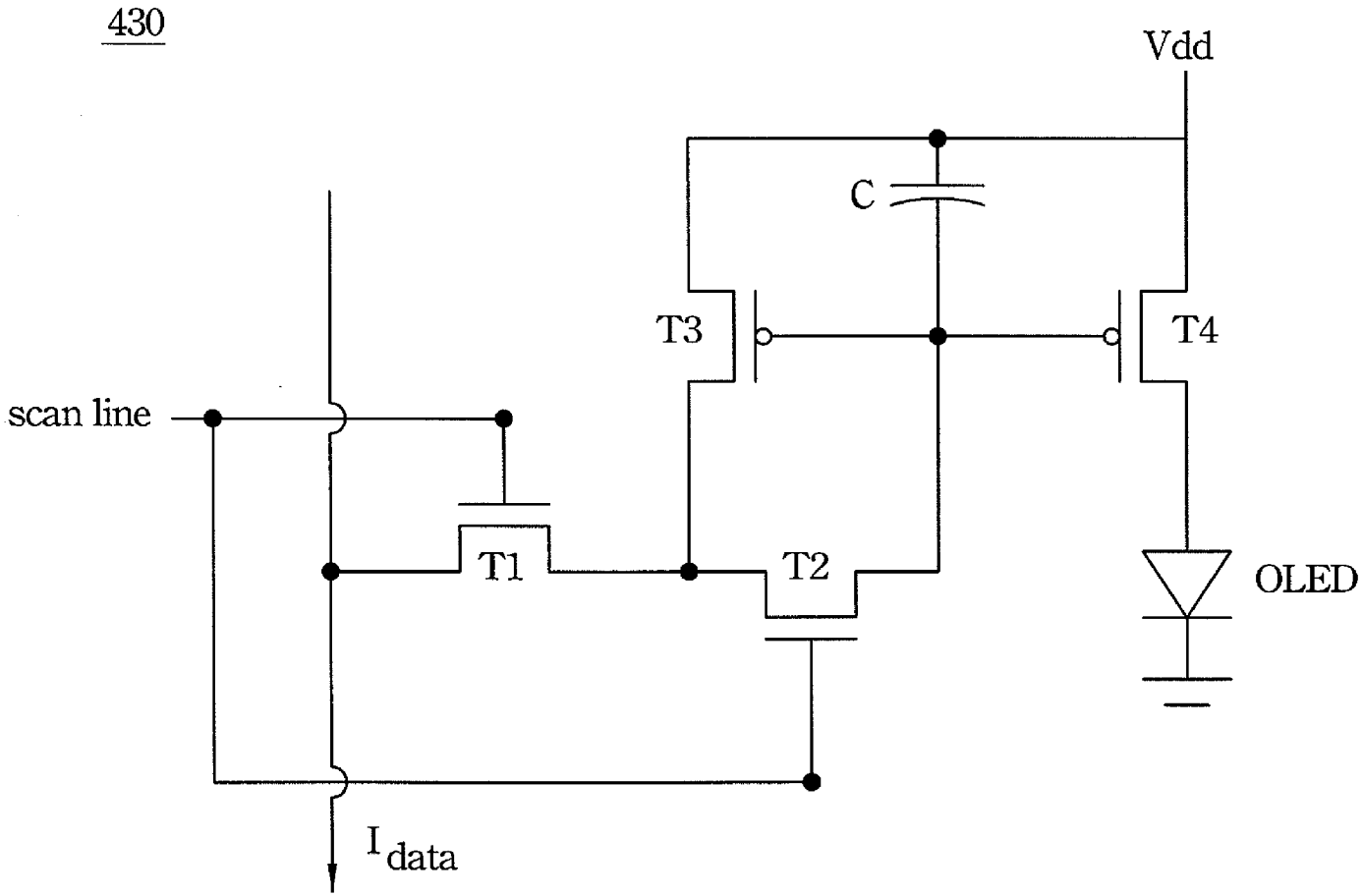
FIG. 4B is an exemplary current-source type pixel circuit receiving the driving current from the data driver of FIG. 4A.

According to another embodiment, the converting transistor 406 can be a NMOS transistor having the gate-to-source voltage VGS, as the data driver 400 illustrated in FIG. 4A, which conducts the driving current $I_{data}$ for a pixel circuit 430 of the current-source type as illustrated in FIG. 4B. In the embodiment, the output voltage $V_{out}$ is coupled to a gate of the converting transistor 406, the driving current $I_{data}$ is outputted from a drain of the converting transistor 406 and a supply voltage GND is coupled to a source of the converting transistor 406. The driving current $I_{data}$ is input into the exemplary current-sink type pixel circuit 430 including four transistors T1, T2, T3, T4 and an OLED. Persons skilled in the art should utilize the converting transistor of the suitable type according to the type of the pixel circuit.

Accordingly, the output voltage $V_{out}$ is selected from the voltages of the tap points 222 which are constituted by the resistors 212 of the resistors string 202. Therefore, it is easy to modify the resistance values of the resistors 212 to achieve the gamma correction of the driving current $V_{out}$ provided for the pixel circuit 230 or 430 in the channel.

Figure 5:
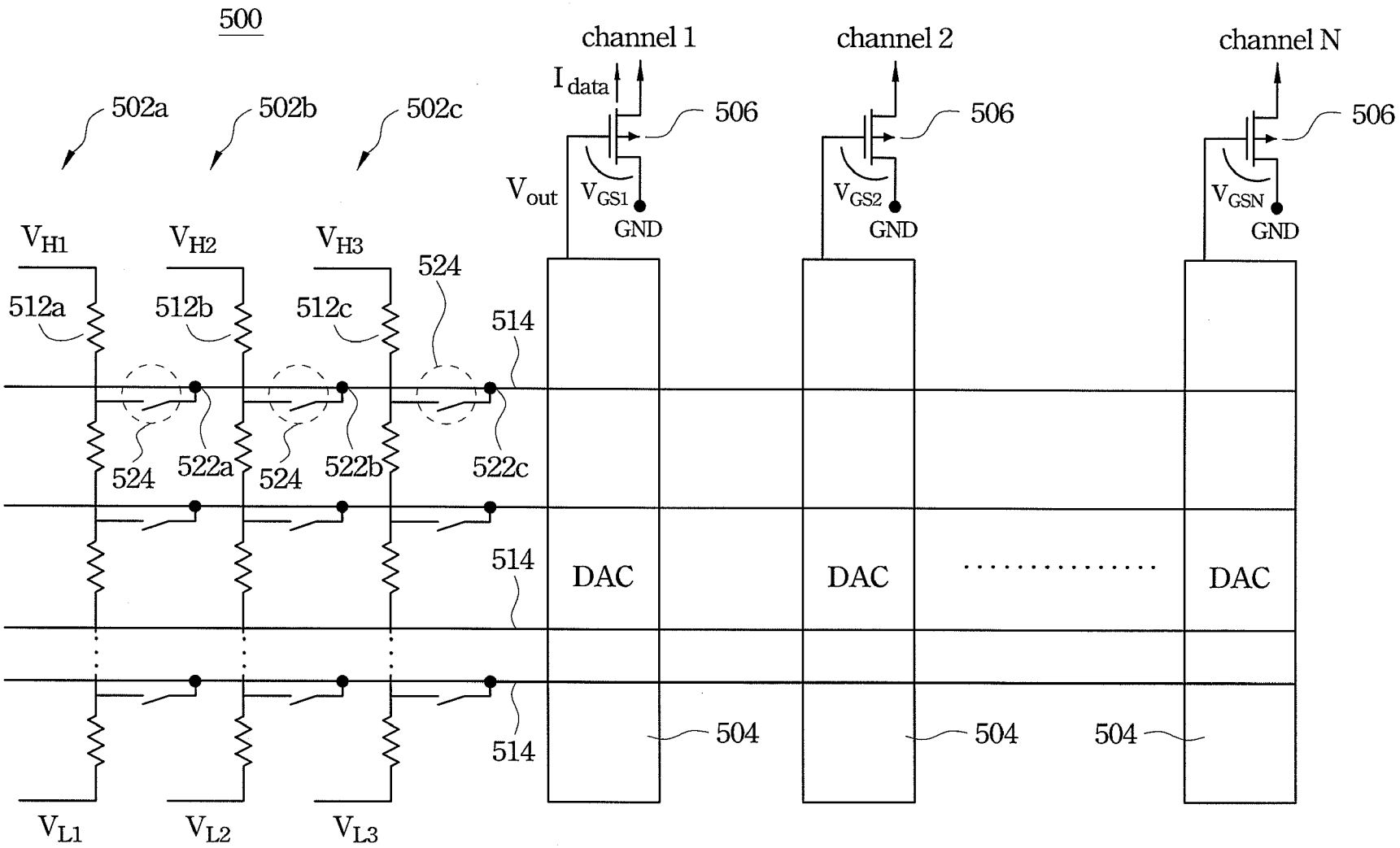
FIG. 5 is a data driver for an OLED display according to another embodiment of the present invention.

FIG. 5 is a data driver 500 for an OLED display according to another embodiment of the present invention. The data driver 500 has resistor strings 502*a*, 502*b* and 502*c*, digital-to-analog converters 504 and converting transistors 506. The resistor strings 502*a*, 502*b* and 502*c* provides several sets of gamma voltages. Each of the digital-to-analog converters 504 converts an input word into an output voltage $V_{out}$ selected from the gamma voltages. Each of the converting transistors 506 conducts a driving current $I_{data}$ and having a gate-to-source voltage VGS determined by the output voltage $V_{out}$ from one of the digital-to-analog converters 504.

The embodiment illustrated in FIG. 5 has more than one resistor strings 502*a*, 502*b* and 502*c*, which provide several sets of gamma voltages, selectively coupled to the digital-to-analog converters 504, for example, by the switches 524. The resistor string 502*a* (or 502*b*, 502*c*) has resistors 512*a* (or 512*b*, 512*c*) connected in series between a high reference voltage $V_{H1}$ (or $V_{H2}$, $V_{H3}$) and a low reference voltage $V_{L1}$ (or $V_{L2}$, $V_{L3}$) and constitutes tap points 522*a* (or 522*b*, 522*c*) to provide the sets of gamma voltages.

The different sets of gamma voltages can correspond to the gamma curves of different colors, respectively, such as red, green, blue, white or other colors. As stated above, the resistance values of the resistors 512*a*, 512*b* and 512*c* in the resistor strings 502*a*, 502*b* and 502*c* can be modified according to the gamma curves of different colors with gamma correction. In addition, the resistor strings 502*a*, 502*b* and 502*c*, the digital-to-analog converters 504 and the converting transistors 506 of the data driver 500 can be manufactured in a single chip.

Figure 6A:
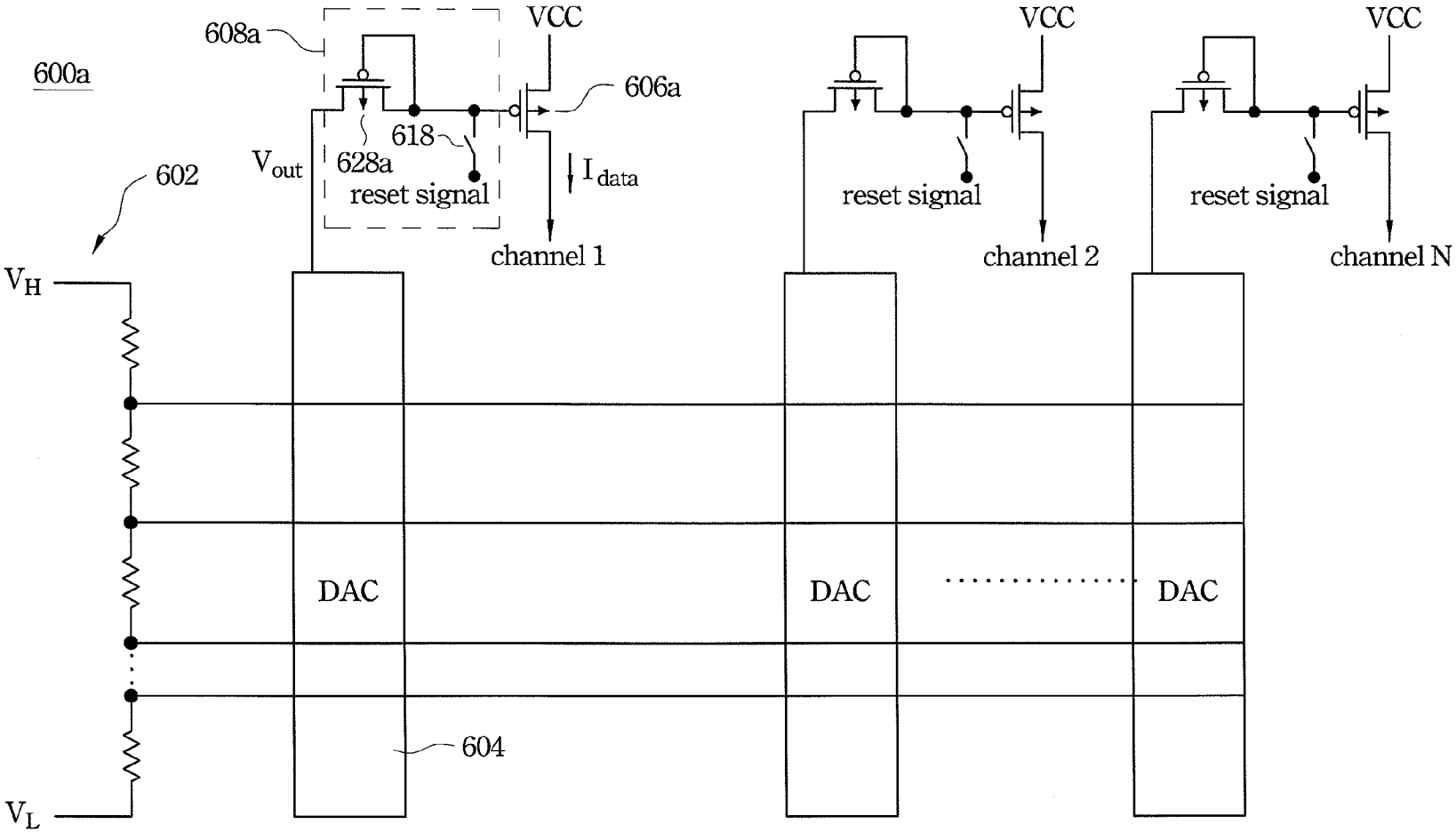
FIG. 6A is a data driver for an OLED display according to another embodiment of the present invention.

FIG. 6A is a data driver for an OLED display according to another embodiment of the present invention. The data driver 600*a* has a resistor string 602, digital-to-analog converters 604, converting transistors 606*a* and threshold voltage compensation circuits 608*a*. The resistor string 602 provides a set of gamma voltages. Each of the digital-to-analog converters 604 converts an input word into an output voltage $V_{out}$ selected from the gamma voltages. Each of the converting transistors 606*a* conducts a driving current $I_{data}$ and having a gate-to-source voltage determined by the output voltage $V_{out}$ from one of the digital-to-analog converters 604. Each of the threshold voltage compensation circuits 608*a* is connected between one of the converting transistors 606*a* and one of the digital-to-analog converters 604.

More particularly, the threshold voltage compensation circuit 606*a* has a compensation transistor 628*a* and a reset switch 618. The compensation transistor 628*a* has a gate and a first source/drain coupled to a gate of the converting transistor 606*a*, and a second source/drain coupled to the output voltage $V_{out}$. The reset switch 618 couples a reset signal to the gate of the converting transistor 606*a*. In the embodiment, the voltage of the reset signal is lower than a lowest gamma voltage of the gamma voltages by a threshold voltage of the compensation transistor 606*a*. Moreover, when the driving current $I_{data}$ is outputted into a pixel circuit, the reset switch 618 is turned off. The embodiment thus can be applied to compensate the threshold voltage offsets among the data drivers formed on different IC chips when the data drivers are cascade in the OLED display.

Figure 6B:
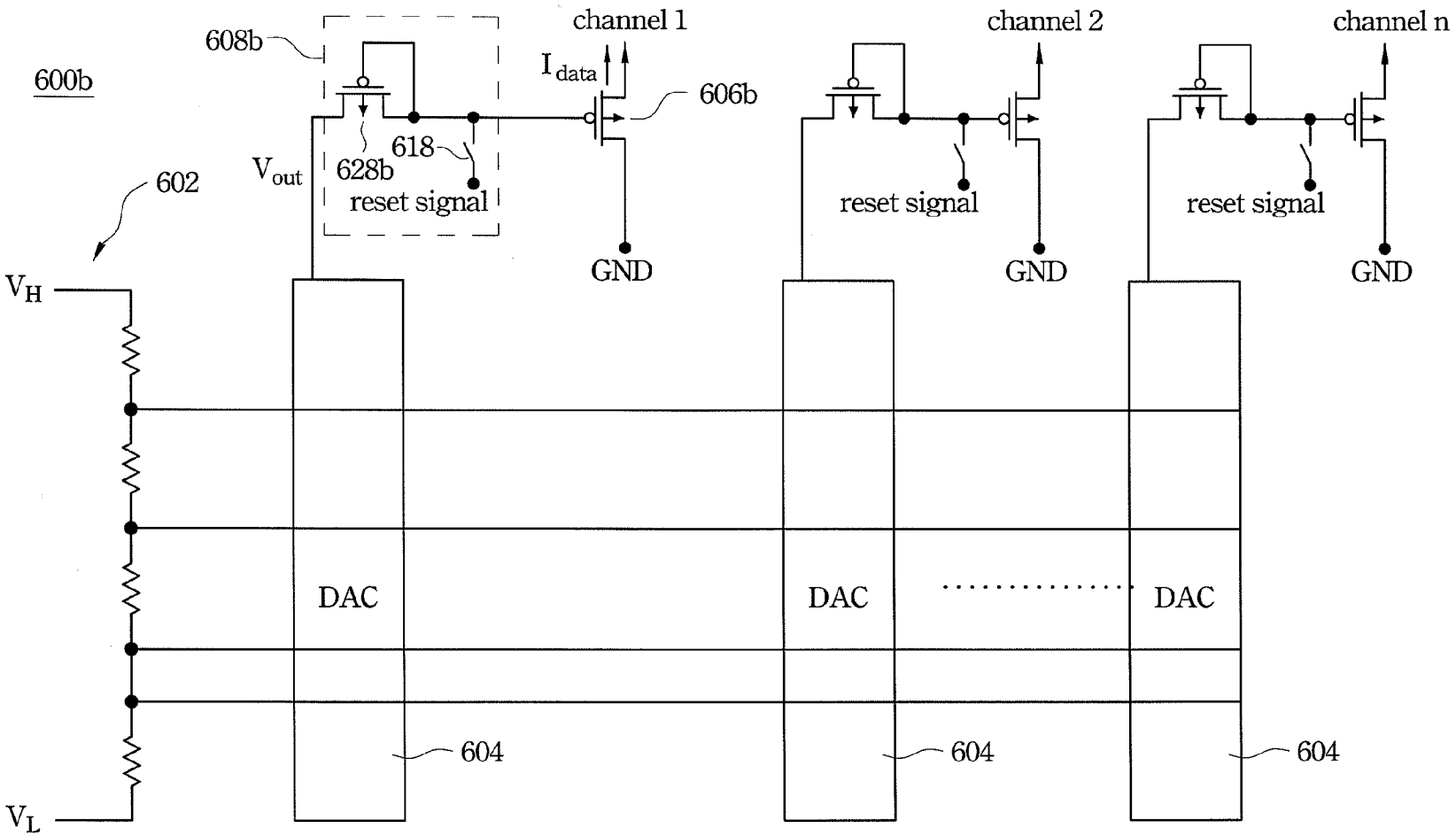
FIG. 6B is a data driver for an OLED display according to another embodiment of the present invention.

The data driver 600*a* as illustrated in FIG. 6A utilizes PMOS transistors as the converting transistors 606*a*, which are provided for the current-sink type pixel circuits in the channels of the OLED display. However, the converting transistors 606*b* also can be NMOS transistors, as the data driver 600*b* illustrated in FIG. 6B, which are provided for the current-source type pixel circuits in the channels of the OLED display. In the data driver 600*b*, the compensation transistors 628*b* of the threshold voltage compensation circuits 606*b* as well are NMOS transistors.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A data driver for an OLED display, comprising:

a resistor string for providing a set of gamma voltages;

a plurality of digital-to-analog converters, each digital-to-analog converter for converting an input word into an output voltage selected from the gamma voltages;

a plurality of converting transistors, each converting transistor for conducting a driving current and having a gate-to-source voltage determined by the output voltage from one of the plurality of digital-to-analog converters; and a plurality of threshold voltage compensation circuits, wherein each threshold voltage compensation circuit is connected between one of the plurality of converting transistors and one of the plurality of digital-to-analog converters, each of the plurality of threshold voltage compensation circuits comprising:

a compensation transistor having a gate and a first source/drain coupled to a gate of the converting transistor, and a second source/drain coupled to the output voltage; and a reset switch for coupling a reset signal to the gate of the converting transistor, wherein a voltage of the reset signal is lower than a lowest gamma voltage of the gamma voltages by a threshold voltage of the compensation transistor.

2. The data driver for an OLED display as claimed in claim 1, wherein the output voltage is coupled to a gate of the converting transistor, the driving current is outputted from a drain of the converting transistor and a supply voltage is coupled to a source of the converting transistor.

3. The data driver for an OLED display as claimed in claim 1, further comprising a plurality of the resistor strings providing different sets of gamma voltages.

4. The data driver for an OLED display as claimed in claim 1, wherein when the driving current is provided to a pixel circuit, the reset switch is turned off.

* * * * *